US009156573B2

(12) United States Patent
Bonneville et al.

(10) Patent No.: US 9,156,573 B2
(45) Date of Patent: Oct. 13, 2015

(54) PACKAGING APPARATUSES AND METHODS

(75) Inventors: Craig R. Bonneville, Black Earth, WI (US); Daryl W. Shackelford, Waunakee, WI (US); Ian Thornley Eisele, Cross Plains, WI (US)

(73) Assignee: Alkar-RapidPak, Inc., Lodi, WI (US)

( * ) Notice: Subject to any disclaimer, the term of this patent is extended or adjusted under 35 U.S.C. 154(b) by 667 days.

(21) Appl. No.: 13/401,473

(22) Filed: Feb. 21, 2012

(65) Prior Publication Data

US 2012/0291399 A1 Nov. 22, 2012

Related U.S. Application Data

(60) Provisional application No. 61/469,488, filed on Mar. 30, 2011.

(51) Int. Cl.

| | |
|---|---|
| ***B65B 11/00*** | (2006.01) |
| ***B65B 25/06*** | (2006.01) |
| ***B65B 9/04*** | (2006.01) |
| ***B65B 47/04*** | (2006.01) |

(Continued)

(52) U.S. Cl.

CPC ..... *B65B 25/065* (2013.01); *B65B 9/04* (2013.01); *B65B 47/04* (2013.01); *B65B 5/068* (2013.01); *B65B 31/02* (2013.01); *B65B 2220/16* (2013.01)

(58) Field of Classification Search

CPC ..... B65B 11/00; B65B 11/52; B65B 5/068; B65B 31/02; B65B 47/00; B65B 47/04

USPC ..... 53/579, 203, 452, 453, 559, 285, 476

See application file for complete search history.

(56) References Cited

U.S. PATENT DOCUMENTS

| | | | | |
|---|---|---|---|---|
| 3,230,869 | A | 1/1966 | Wilkins | |
| 3,315,781 | A | 4/1967 | Eberman et al. | |
| 3,354,611 | A * | 11/1967 | Powell | 53/559 |

(Continued)

FOREIGN PATENT DOCUMENTS

| | | |
|---|---|---|
| DE | 2235280 | 1/1974 |
| DE | 90 10 832 U1 | 9/1990 |

(Continued)

OTHER PUBLICATIONS

Brochure entitled "Low-Profile Plug Assist", Alkar-RapidPak, Inc., Apr. 2007.

(Continued)

*Primary Examiner* — Gloria R Weeks
*Assistant Examiner* — Eduardo R Ferrero
(74) *Attorney, Agent, or Firm* — Andrus Intellectual Property Law, LLP

(57) ABSTRACT

A forming station comprises first and second forming die members. A closing station comprises first and second closing die members. A lift operatively couples at least three of the members together such that operation of the lift moves the three members together. The closing station is located downstream of the loading station and is for closing a pocket in a first web of packaging material with a second web of packaging material. The second web of packaging material is oriented in the closing station so as to engage with the first web of packaging material and fold a foldable flap downwardly with respect to a conveyor as the conveyor moves from upstream to downstream.

19 Claims, 11 Drawing Sheets

(51) Int. Cl.
*B65B 5/06* (2006.01)
*B65B 31/02* (2006.01)

(56) References Cited

U.S. PATENT DOCUMENTS

| | | | | | |
|---|---|---|---|---|---|
| 3,467,244 | A | * | 9/1969 | Hamilton et al. | 426/111 |
| 3,524,298 | A | * | 8/1970 | Hamilton | 53/433 |
| 3,762,125 | A | | 10/1973 | Prena | |
| 3,808,772 | A | | 5/1974 | Turtschan | |
| 4,003,184 | A | | 1/1977 | Shiu | |
| 4,008,554 | A | * | 2/1977 | Hardy | 53/453 |
| 4,034,536 | A | * | 7/1977 | Mahaffy et al. | 53/433 |
| 4,047,358 | A | * | 9/1977 | Heffernan et al. | 53/453 |
| 4,094,127 | A | * | 6/1978 | Romagnoli | 53/51 |
| 4,137,784 | A | * | 2/1979 | Griffin | 74/89.37 |
| 4,265,070 | A | * | 5/1981 | Mainberger et al. | 53/433 |
| 4,266,389 | A | * | 5/1981 | Linde et al. | 53/396 |
| 4,370,112 | A | | 1/1983 | Sorbier | |
| 4,449,907 | A | | 5/1984 | Yonezawa et al. | |
| 4,496,417 | A | * | 1/1985 | Haake et al. | 156/361 |
| 4,529,371 | A | | 7/1985 | Nickley | |
| 4,552,789 | A | * | 11/1985 | Winchell | 428/132 |
| 4,744,197 | A | * | 5/1988 | Conforto et al. | 53/397 |
| 4,747,250 | A | * | 5/1988 | Rossi | 53/511 |
| 4,757,666 | A | * | 7/1988 | Janhonen | 52/176 |
| 4,773,839 | A | | 9/1988 | Case et al. | |
| 4,894,248 | A | * | 1/1990 | Pappas et al. | 426/121 |
| 4,894,977 | A | | 1/1990 | Rittinger et al. | |
| 4,897,985 | A | | 2/1990 | Buchko et al. | |
| 4,915,283 | A | | 4/1990 | Buchko et al. | |
| 4,987,725 | A | | 1/1991 | Gill | |
| 5,014,500 | A | | 5/1991 | Robache | |
| 5,070,681 | A | * | 12/1991 | Romagnoli | 53/566 |
| 5,087,498 | A | * | 2/1992 | Nedblake et al. | 428/76 |
| 5,170,611 | A | * | 12/1992 | Buchko et al. | 53/453 |
| 5,205,110 | A | * | 4/1993 | Buchko | 53/453 |
| 5,249,406 | A | * | 10/1993 | Kalmanides | 53/377.5 |
| 5,302,227 | A | * | 4/1994 | Dalrymple et al. | 156/443 |
| 5,307,610 | A | * | 5/1994 | Schneider et al. | 53/559 |
| 5,443,150 | A | | 8/1995 | Buchko | |
| 5,477,660 | A | * | 12/1995 | Smith | 53/433 |
| 5,517,805 | A | * | 5/1996 | Epstein | 53/453 |
| 5,570,569 | A | * | 11/1996 | Masuda | 53/410 |
| 5,682,729 | A | * | 11/1997 | Buchko | 53/453 |
| 5,716,314 | A | * | 2/1998 | Lauderbaugh | 493/441 |
| 5,765,336 | A | * | 6/1998 | Neagle et al. | 53/201 |
| 5,785,270 | A | | 7/1998 | Buchko | |
| 5,813,197 | A | | 9/1998 | Aguzzoli | |
| 6,085,490 | A | | 7/2000 | Buchko | |
| 6,240,706 | B1 | | 6/2001 | Thomas et al. | |
| 6,523,462 | B1 | | 2/2003 | Johnson et al. | |
| 6,604,452 | B2 | | 8/2003 | Hanson et al. | |
| 6,843,043 | B2 | | 1/2005 | Hanson et al. | |
| 6,916,280 | B2 | * | 7/2005 | Tonnigs et al. | 493/424 |
| 6,941,729 | B2 | | 9/2005 | Dal Pozzo | |
| 7,055,296 | B2 | | 6/2006 | Christ | |
| 7,121,063 | B2 | | 10/2006 | Haws | |
| 7,195,552 | B1 | | 3/2007 | Johnson et al. | |
| 7,325,370 | B2 | * | 2/2008 | Redmond | 53/133.8 |
| 7,325,486 | B1 | | 2/2008 | Nordby et al. | |
| 7,340,871 | B1 | | 3/2008 | Shackelford et al. | |
| 7,416,479 | B2 | | 8/2008 | Johnson et al. | |
| 7,458,197 | B2 | | 12/2008 | Hanson et al. | |
| 7,490,448 | B1 | * | 2/2009 | Bonneville et al. | 53/75 |
| 7,607,279 | B2 | | 10/2009 | Shackelford et al. | |
| 7,607,973 | B1 | | 10/2009 | Beld et al. | |
| 7,629,012 | B2 | | 12/2009 | Karman et al. | |
| 7,833,002 | B2 | * | 11/2010 | Buchko et al. | 425/383 |
| 8,186,134 | B2 | * | 5/2012 | Shackelford et al. | 53/558 |
| 2004/0016205 | A1 | | 1/2004 | Douglas | |
| 2004/0068956 | A1 | * | 4/2004 | Hartness et al. | 53/247 |
| 2008/0142407 | A1 | * | 6/2008 | Moore | 206/583 |
| 2009/0013880 | A1 | | 1/2009 | Nordby et al. | |
| 2009/0100804 | A1 | | 4/2009 | Bonneville | |
| 2009/0104327 | A1 | | 4/2009 | Pulsfus et al. | |
| 2009/0241485 | A1 | * | 10/2009 | Buchko et al. | 53/543 |
| 2009/0260320 | A1 | | 10/2009 | Miller et al. | |
| 2010/0287888 | A1 | * | 11/2010 | Shackelford et al. | 53/453 |
| 2012/0291399 | A1 | * | 11/2012 | Bonneville et al. | 53/203 |

FOREIGN PATENT DOCUMENTS

| | | | |
|---|---|---|---|
| DE | 202004016538 | | 2/2005 |
| DE | 102004051923 | | 5/2006 |
| DE | 102007062983 | | 6/2009 |
| DE | 10 2008 045025 | A1 | 3/2010 |
| EP | 0 467 069 | A1 | 1/1992 |
| EP | 1234765 | | 8/2002 |
| EP | 2110219 | | 10/2009 |
| EP | 2 253 544 | A2 | 11/2010 |
| EP | 2 463 204 | A2 | 6/2012 |
| GB | 1 184 481 | A | 3/1970 |
| WO | 2009083200 | | 7/2009 |

OTHER PUBLICATIONS

European Search Report for European Patent Application No. 08018448.4, having a completion date of Feb. 11, 2009.

Brochure for Multivac M100 Automatic Rollstock Machine, 1984-1987 (1995), 4 pages.

Partial European Search Report for European Patent Application No. 10005159.8, having a completion date of Aug. 26, 2010.

Extended European Search Report for European Patent Application No. 10005159.8, having a completion date of Jan. 25, 2011.

Partial European Search Report for European Patent Application No. 10005160.6, having a completion date of Aug. 26, 2010.

Extended European Search Report for European Patent Application No. 10005160.6, having a completion date of Jan. 24, 2011.

European Search Report for European Patent Application No. 14000464.9, dated Mar. 7, 2014.

European Search Report for European Patent Application No. 12 00 1964, having a completion date of Feb. 27, 2013.

Partial European Search Report for European Patent Application No. 12 00 1964, having a completion date of Jul. 30, 2012.

Notice of Opposition for Patent No. EP 2 253 543 B1, including Annexes, dated Sep. 10, 2013.

* cited by examiner

PACKAGING APPARATUSES AND METHODS

CROSS-REFERENCE TO RELATED APPLICATION

The present application relates to and claims priority to and the benefit of U.S. Provisional Patent Application No. 61/469,488, filed Mar. 30, 2011, the disclosure of which is hereby incorporated herein by reference.

FIELD

The present disclosure relates to apparatus and methods for packaging.

BACKGROUND

U.S. Pat. Nos. 5,170,611 and 5,205,110, the disclosures of which are hereby incorporated herein by reference, disclose indexing motion apparatuses and methods for vacuum packaging of articles such as hot dogs, sliced luncheon meat, cheese or pharmaceuticals.

U.S. patent application Ser. Nos. 12/605,101 and 12/605,171, the disclosures of which are hereby incorporated herein by reference, disclose packaging machines including web transport conveyors transporting webs of flexible packaging material from upstream to downstream locations through a series of stations; and packaging apparatuses including a forming station and a closing station, each having a movable die member that is counterbalanced.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one example an indexing-motion packaging machine comprises a web transport conveyor transporting a web of flexible packaging material from upstream to downstream locations through a series of stations including a forming station for forming at least one pocket in the web, a loading station for placing food product in the pocket, and a closing station for closing the pocket with another web of packaging material. In the machine, a packaging apparatus comprises (1) a forming station comprising first and second forming die members, at least one of the first and second forming die members being movable between open and closed positions relative to the other of the first and second forming die members to form the pocket; (2) a closing station comprising first and second closing die members, at least one of the first and second closing die members being movable between open and closed positions relative to the other of the first and second closing die member to close the pocket; and (3) a lift that operatively couples at least three members of the first and second forming die members and first and second closing die members together such that operation of the lift counterbalances and moves the three members together between the respective open and closed positions.

In another example, in a packaging machine comprising a web transport conveyor transporting a web of flexible packaging material from upstream to downstream locations through a series of stations including a forming station for forming at least one pocket in a first web of packaging material and a loading station for placing food product in the pocket. The food product has packaging material comprising a foldable flap extending generally outwardly away from the conveyor. A packaging apparatus comprises a closing station located downstream of the loading station and for closing the pocket with a second web of packaging material. The second web of packaging material is oriented in the closing station so as to engage with the first web of packaging material and also fold the foldable flap downwardly with respect to the conveyor as the conveyor moves from upstream to downstream.

BRIEF DESCRIPTION OF THE DRAWINGS

Embodiments of packaging apparatuses and methods are described with reference to the following figures. The same numbers are used throughout the figures to reference like features and components.

DETAILED DESCRIPTION OF THE DRAWINGS

In the present description, certain terms have been used for brevity, clearness and understanding. No unnecessary limitations are to be inferred therefrom beyond the requirement of the prior art because such terms are used for descriptive purposes only and are intended to be broadly construed. The different apparatus and methods described herein may be used alone or in combination with other systems and methods.

Figure 1:
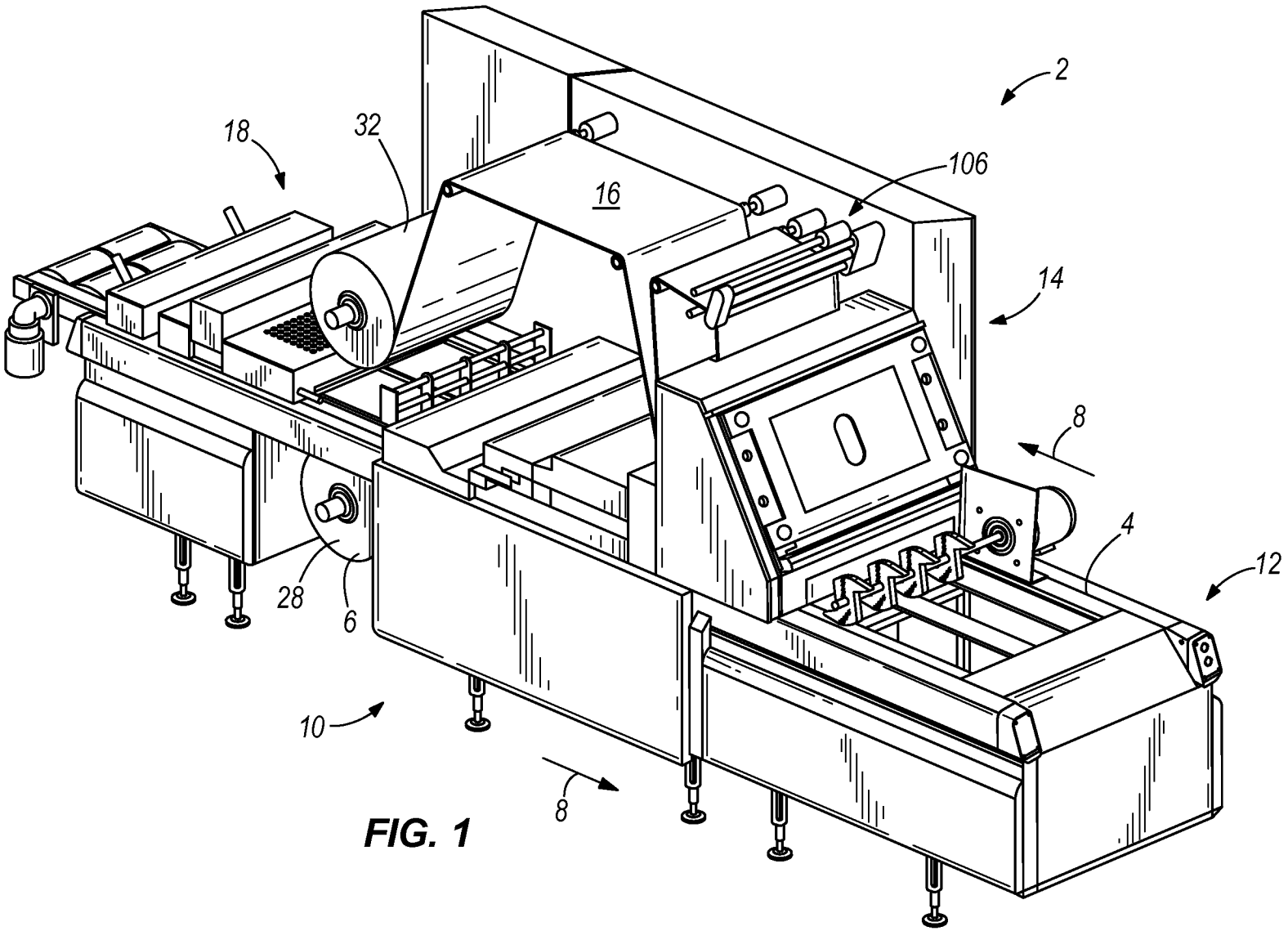
FIG. 1 is a perspective view of a packaging machine.
Figure 2:
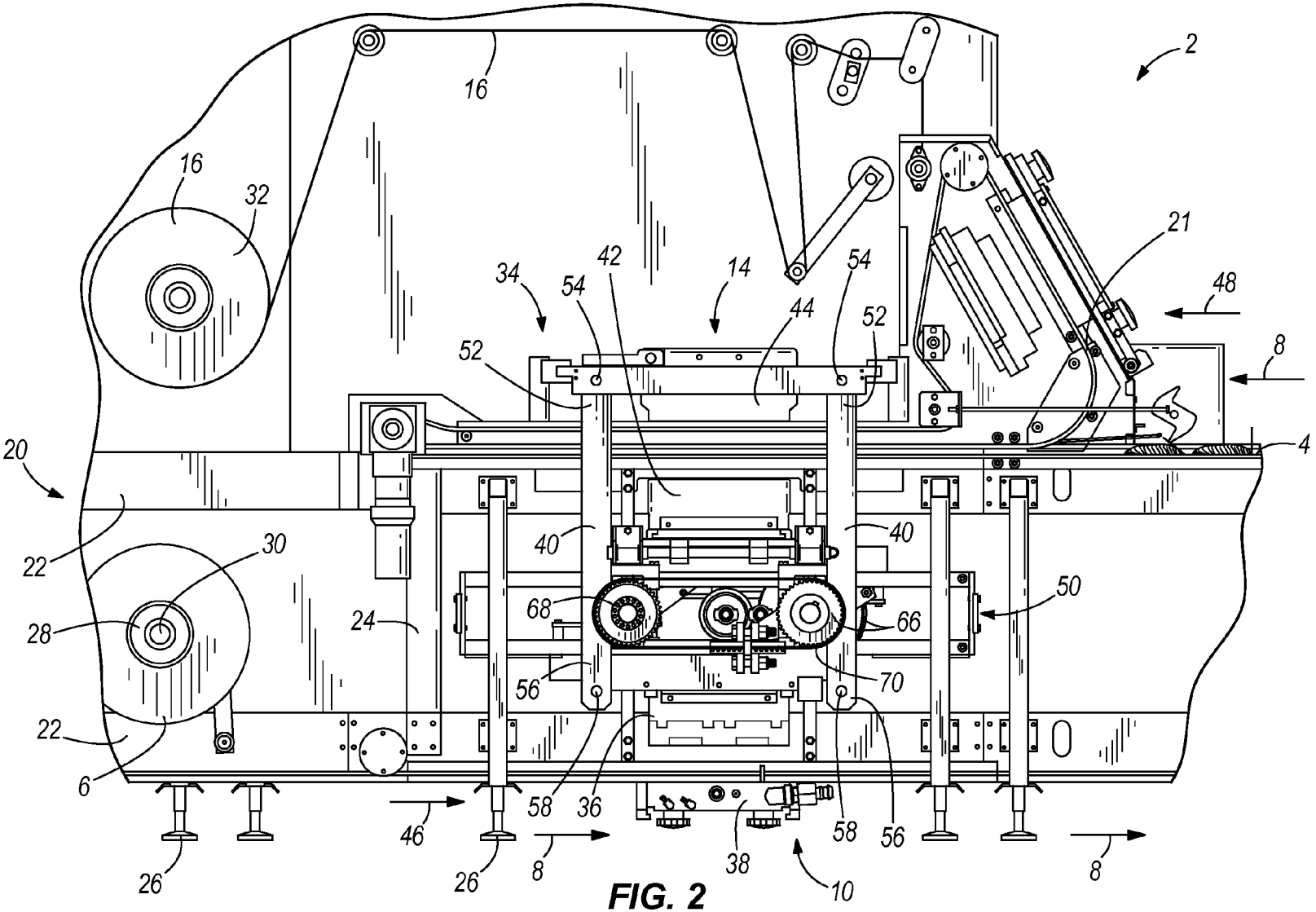
FIG. 2 is a side view of the packaging apparatus in the packaging machine.

FIGS. 1 and 2 depict an indexing motion packaging machine 2 that includes a web transport conveyor 4 transporting a web 6 of flexible packaging material along a direction of transport depicted by arrows 8 from upstream to downstream through a series of stations including a forming station 10 for forming at least one pocket P in the web 6, a loading station 12 for placing food product in the pocket P and a closing station 14 for closing the pocket P with another web 16 of flexible packaging material. In the examples depicted, the machine 2 also optionally includes a cutting station 18 for separating the closed pockets P into individual food containing packages.

As depicted in FIG. 2, the various components of the machine are mounted to and supported by a frame 20 including spaced parallel upper and lower frame members 22 and vertical frame members 24. A series of legs, e.g. 26, support machine 2 above the ground. A supply roll 28 supplies the web 6. The supply roll 28 rotates about an unwind shaft 30 to supply the web 6 along the direction 8. An unwind motor (not shown) drives a set of rollers and a timing pulley to safely pull the web 6 from the supply roll 28 and along the conveyor 4 in an indexing manner and to allow a series of operations at the forming station 10, loading station 12, closing station 14, and cutting station 18 for creating a packaged product. A supply roll 32 supplies the web 16 along an arcuate path 21 (as will be described further herein below) to engage and close the noted pocket. The rotational operation of the supply rolls 28 and 32 is similar to the operation of the supply roll arrangement depicted in U.S. Pat. No. 5,205,110, incorporated herein by reference. For brevity, further description of the supply rolls 28 and 32 and their functions are not provided herein. It will be understood by those skilled in the art that any arrangement for safely supplying a web of flexible packaging material along a web transport direction is suitable for use with the presently described embodiments.

Figure 3:
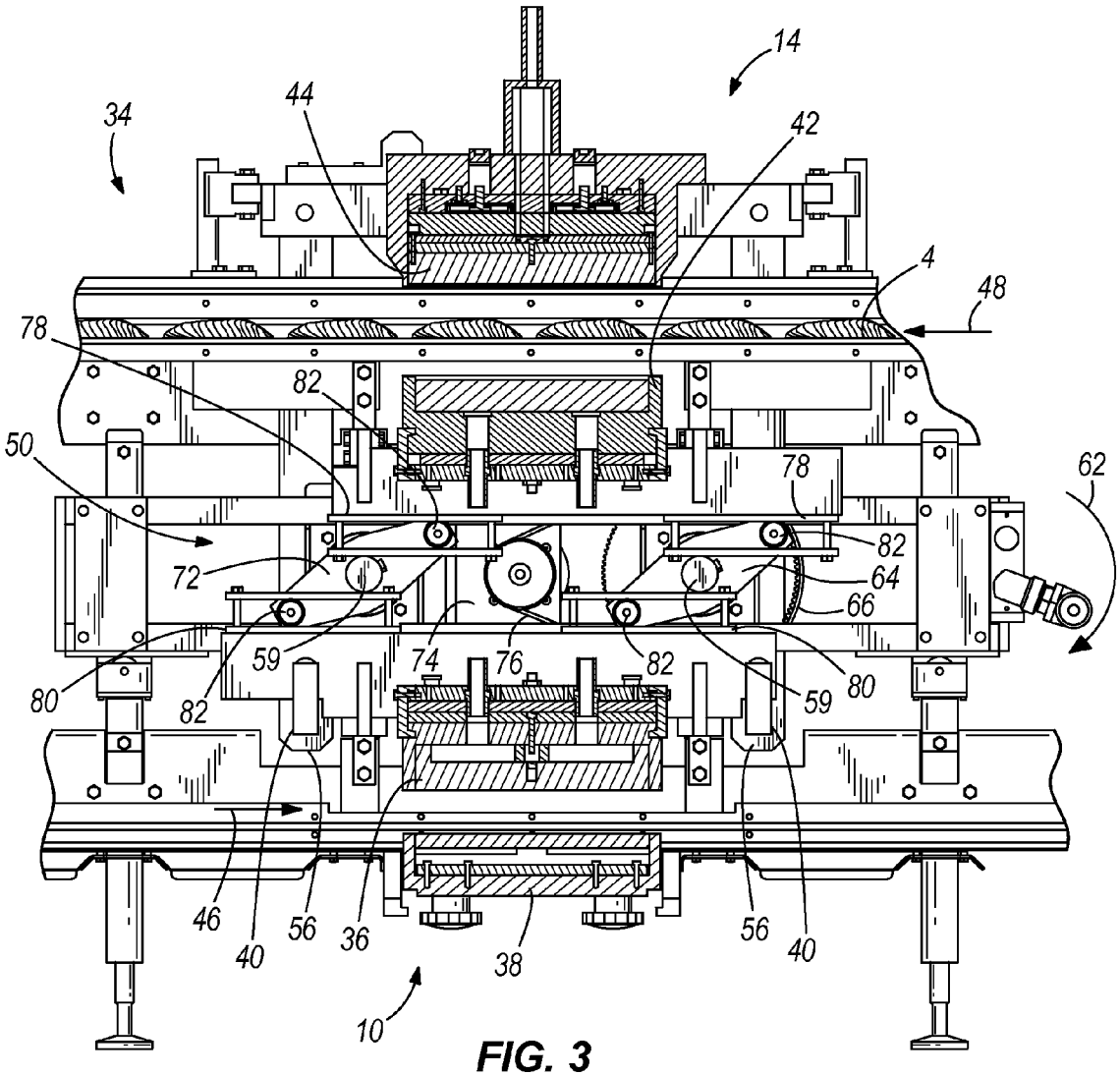
FIG. 3 is an interior section view of the packaging apparatus.
Figure 4:
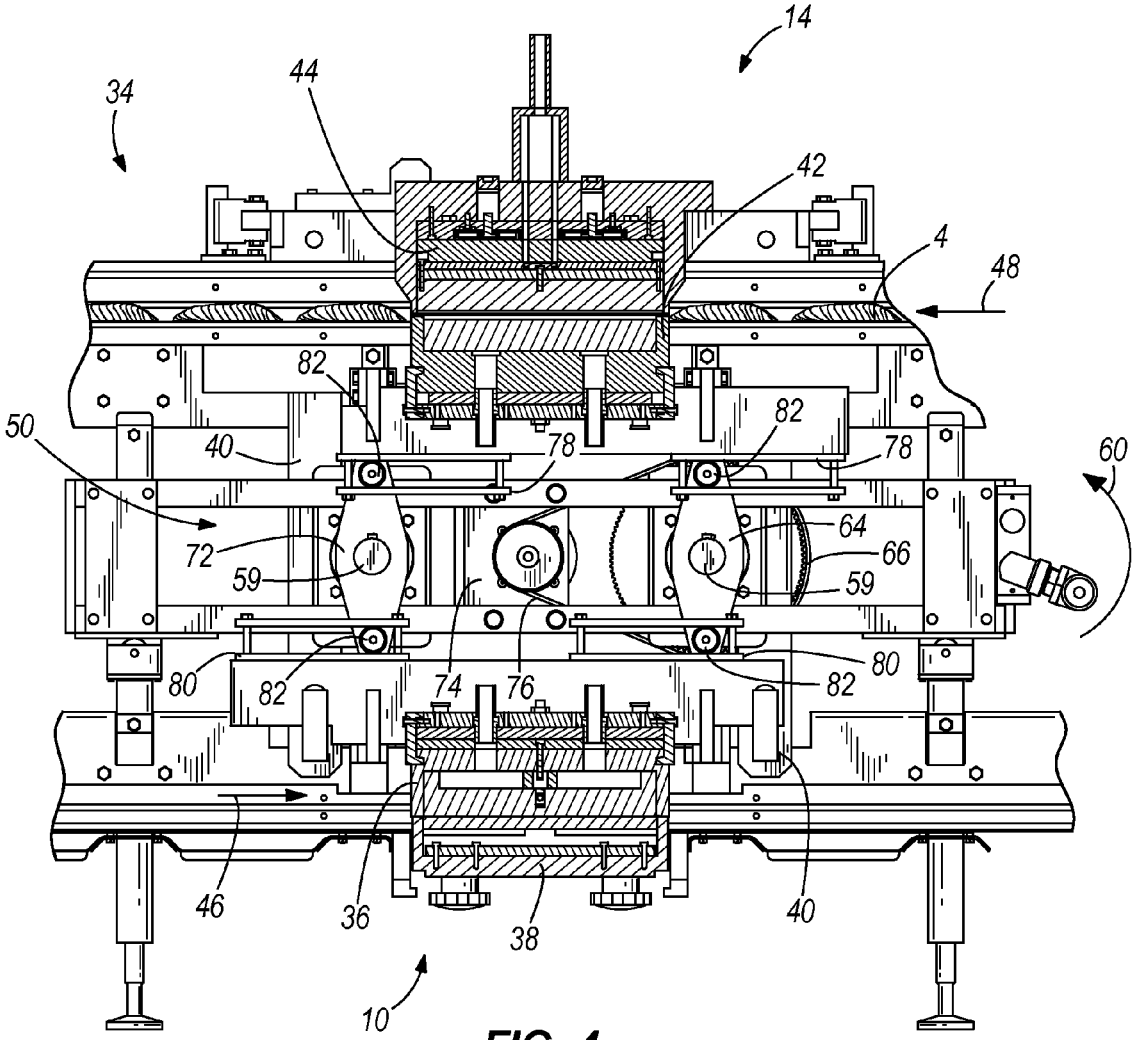
FIG. 4 is an interior section view of the packaging apparatus.
Figure 11:
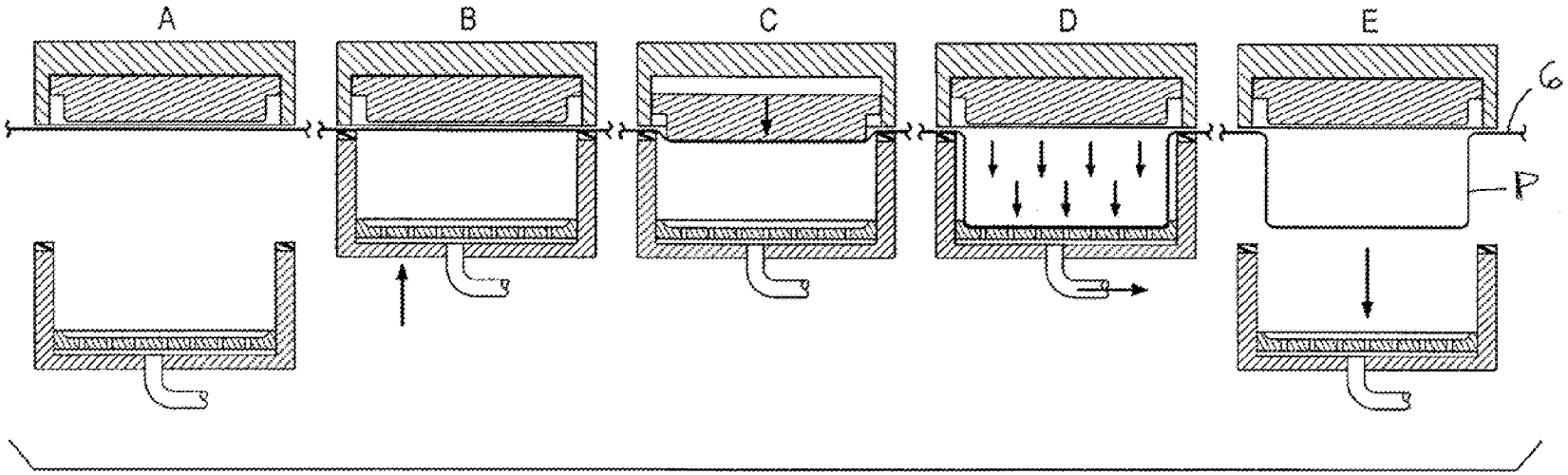
FIG. 11 is a schematic side view showing the steps involved in deforming the flexible web of packaging material at the forming station to provide a product cavity in the form of a pocket adapted to receive product to be packaged.

As shown in FIGS. 2-4, packaging apparatus 34 is incorporated into the machine 2. The apparatus 34 includes the forming station 10, which includes first and second forming die members 36, 38 that mutually cooperate to form the pocket P in the web 6. In the embodiment shown, the first forming die member 36 includes a die box connected to a vacuum supply for vacuum forming the pocket P in the web 6. The first forming die member 36 is movable away from and towards the second forming die member 38 between an open position to allow movement of the web 6 in the direction 8 and a closed position, wherein the forming die member 36 engages with the forming die member 38 to sandwich the web 6 therebetween and receive a vacuum to assist in formation of the noted pocket P in the web. (See FIG. 11) Vacuum forming of a web is described in the incorporated U.S. Pat. No. 5,205,110. It will be understood by those skilled in the art that arrangements other than that disclosed in U.S. Pat. No. 5,205,110 for forming a pocket P in the web 6 are suitable for use in combination with the presently described embodiments and in addition to or instead of the arrangement described in U.S. Pat. No. 5,205,110. In addition, although the forming station 10 depicted and described includes a forming die member 36 that is movable relative to a stationary forming die member 38, those skilled in the art will recognize that the forming station 10 could instead include forming die members 36, 38 that are both movable relative to each other.

The apparatus 34 also includes the closing station 14 including first and second closing die members 42, 44, which mutually cooperate to close the noted pocket in the web with the second web 16 of flexible packaging material. In the embodiment shown, the closing die member 42 includes a die box that cooperates with a heat sealing mechanism to seal the web 16 to the web 6 in a manner similar to that described in U.S. Pat. No. 5,205,110. Both closing die member 42 and closing die member 44 are movable between an open position to allow movement of the web 6 in the direction 8 and a closed position to close the pocket P with the web 16.

In the example shown, the forming die member 36 and closing die members 42, 44 are counterbalanced so that movement of one of these members towards its closed position assists movement of the others of these members towards their closed positions, and so that movement of one of these members towards its open position assists movement of the others of these members towards their open positions. The counterbalanced interrelationship between the die members 36, 42 and 44 can be accomplished in different ways. In the embodiments shown, the forming die member 36 is inverted with respect to the closing die member 42 and the forming station 10 is located below the closing station 14 in the machine 2. In this respect, the forming station 10 and closing station 14 are oriented such that the web 6 enters the forming station 10 from one direction shown at arrow 46 and enters the closing station 14 from the other, opposite direction shown at arrow 48.

Counterbalancing between the respective die members 36, 42 and 44 is facilitated by a lift 50 operatively coupling the forming die member 36 and closing die members 42, 44. The lift 50 can include different mechanisms that facilitate counterbalanced, driven motion between the respective die members 36, 42 and 44, so that the movement of the lift 50 moves the forming die member 36 towards its closed position and the closing die members 42, 44 towards their closed positions, and so that opposite movement of the lift 50 moves the forming die member 36 towards its open position and the closing die members 42, 44 towards their open positions.

In the embodiments shown, the respective die members 36 and 42 are inverted with respect to each other and the lift 50 is disposed between the forming station 10 and the closing station 14. The lift 50 is located vertically higher than the forming station 10 and vertically lower than the closing station 14. In operation, the lift 50 rotates in a first direction to move the respective die members 36, 42 away from each other towards their respective closed positions. A pair of links 40 on each side of the apparatus (which together make four links) connects the die member 36 to the die member 44 such that the die members 36, 44 move together during operation of the lift 50. The number and location of links 40 can vary. Link 40 has an upper end 52 that is pivotably connected to the closing die member 44 at a pivot point 54 and a lower end 56 that is pivotably connected to the sealing die member 36 at a similar pivot point 58. In this manner, the die member 44 is coupled to and moves into its closed position at the same time as the die member 36. The lift 50 rotates in a second, opposite direction to move the respective die members 36, 42 towards each other and towards their respective open positions. Simultaneously, movement of the die member 36 is reflected in the die member 44 via the operable connection at links 40. Thus, the die member 44 also moves into its respective open position.

Referring to FIGS. 3 and 4, movement of lift 50 facilitates counterbalanced motion between the respective die members as described in the incorporated U.S. patent application Ser. Nos. 12/605,101 and 12/605,171. As described in those applications, the lift 50 can be operably driven by a motor, which in one example includes a servo motor. This type of arrangement is described in the incorporated U.S. Patent Applications, for example in FIGS. 3-8 of those disclosures, and the related description thereof. Briefly, the respective die members 36, 42 are inverted with respect to each other and the lift 50 is disposed between the forming station 10 and the closing station 14. The lift 50 is located vertically higher than the forming station 10 and vertically lower than the closing station 14. In operation, the lift 50 rotates in a first direction shown at arrow 62 (FIG. 3) to move the respective die members 36, 42 towards each other and towards their respective open positions. The lift 50 rotates in a second, opposite direction shown at arrow 60 (FIG. 4) to move the respective die members 36, 42 away from each other and towards their respective closed positions.

Movement of lift 50 facilitates counterbalanced motion between the respective die members 36, 42, 44. In the example shown, the lift 50 includes a pair of drive arms 64 on each side of the apparatus 34. One drive arm 64 is shown in FIGS. 3 and 4. Drive arm 64 rotates about a pivot axis 59 and has a first end operatively connected to the closing die member 42 and a second, opposite end operatively connected to the forming die member 36. The lift 50 also includes a drive wheel 66 (FIG. 2) operatively connected to the drive arms 64. This can be accomplished in different ways. As described in the above-incorporated applications, rotation of the drive wheel 66 causes rotation of the drive arms 64 about the pivot axis 59 and causes movement of the interconnected closing die member 42, the forming die box 36 and the closing member 44 into and out of the respective open and closed positions.

In the example shown, the lift 50 also includes a follower wheel 68 (FIG. 2) that is operatively connected to the drive wheel 66 so that rotation of the drive wheel 66 causes rotation of the follower wheel 68. Connection of the follower wheel 68 to the drive wheel 66 can be accomplished in different ways. In the example shown the connection is accomplished by a belt 70 that operatively connects the follower wheel 68 to the drive wheel 66.

A pair of follower arms 72 is operatively connected to the follower wheel 68 so that rotation of the follower wheel 68 causes rotation of the follower arms 72. One follower arm 72 is shown in FIGS. 3 and 4. Rotation of the follower arms 72 can be accomplished in different ways, and in the example shown is accomplished by connection of the follower wheel 68 to a rotatable shaft to which the follower arms 72 are keyed so that the follower arms 72 rotate concentrically and along with the follower wheel 68. Each follower arm 72 has a first end operatively connected to the movable first closing die member 42 and a second, opposite end operatively connected to the forming die member 36. As explained further below, rotation of the follower arms 72 causes movement of the closing die member 42 and the forming die member 36 into and out of the open and closed positions.

A servo motor 74 (FIGS. 3 and 4) is connected to the drive wheel 66 by a belt 76 and operatively drives the drive wheel 66 into rotation in a back and forth direction. This causes drive arms 64 to rotate back and forth between the positions shown in (FIGS. 3 and 4). Rotation of the drive wheel 66 is translated to follower wheel 68 via belt 70 and thus causes rotation of follower wheel 68 in the same timing and orientation. Rotation of follower wheel 68 causes rotation of follower arms 72 back and forth between the positions shown in (FIGS. 3 and 4).

Referring to (FIGS. 3 and 4), respectively, pivoting movement of the drive arms 64 and follower arms 72 causes movement of the die members 36, 42 into and out of the noted open and closed positions. This can be accomplished in different ways. In the example shown, first ends of the drive arms 64 travel along guide tracks 78 operatively connected to the closing die member 42 and the second ends of the drive arms 64 travel along guide tracks 80 operatively connected to the forming die member 36. Both of the guide tracks 78, 80 include first and second rails. Bearings 82 are operatively connected to the ends of the drive arms 64 and are disposed between and configured to ride along the rails of the guide tracks 78, 80.

Follower arms 72 also have bearings that ride in guide tracks 78, 80 including rails. The structure and operation of the follower arms 72 is thus driven by and follows the operation of the drive arms 64. Operation of the servo motor 74 thus causes rotation of both the drive arms 64 and the follower arms 72 to move the movable die members 36, 42 into and out of the open and closed positions shown in FIGS. 3 and 4, respectively. Specifically, rotation of the drive arms 64 causes bearings 82 to ride along guide tracks 78, 80 and push the forming die member 36 and closing die member 42 into and out of the open and closed positions. In the same way, rotation of the follower arms 72 causes bearings 82 to ride along the guide tracks 78, 80 and push the forming die member 36 and closing die member 42 into and out of the open and closed positions. Simultaneously, movement of the forming die member 36 is reflected in the closing die member 44 because of the operative coupling by links 40.

Figure 5:
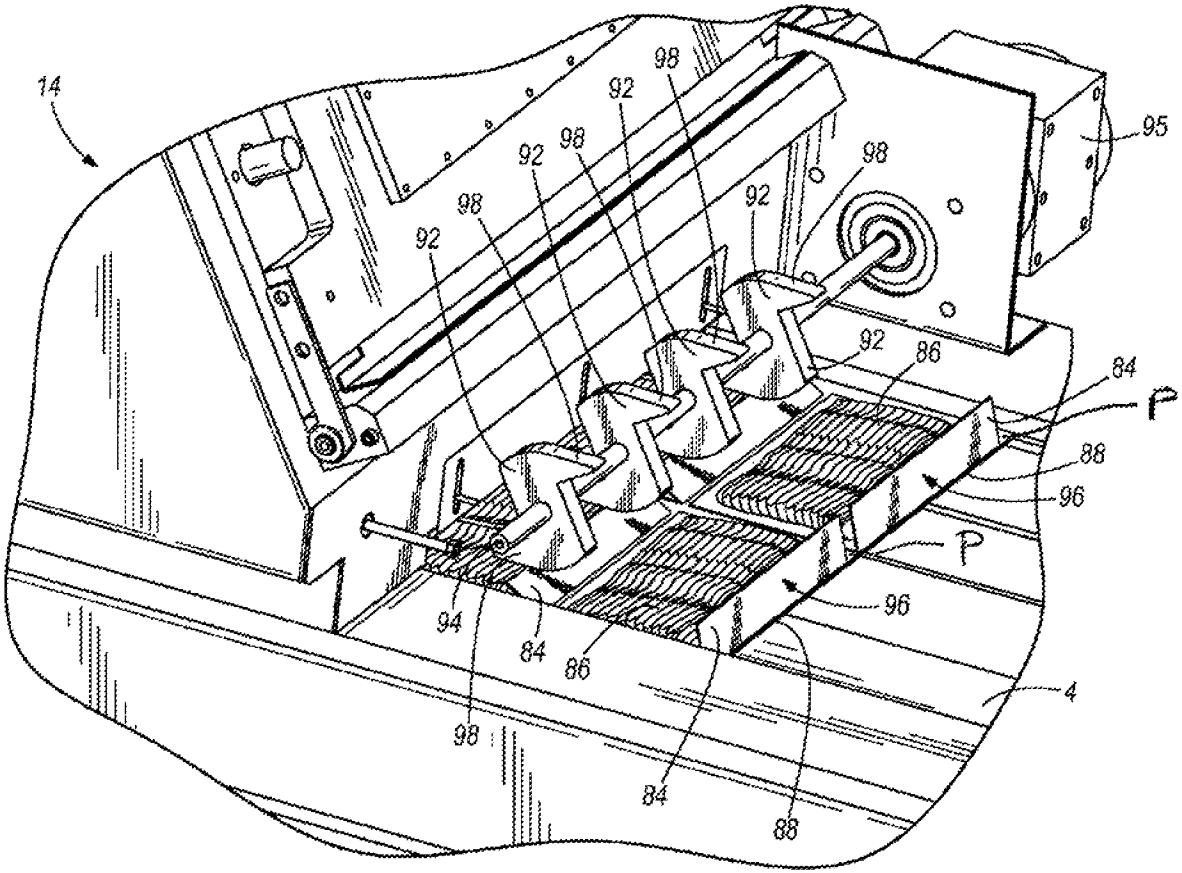
FIG. 5 is a perspective view of a closing station in the packaging machine.
Figure 6:
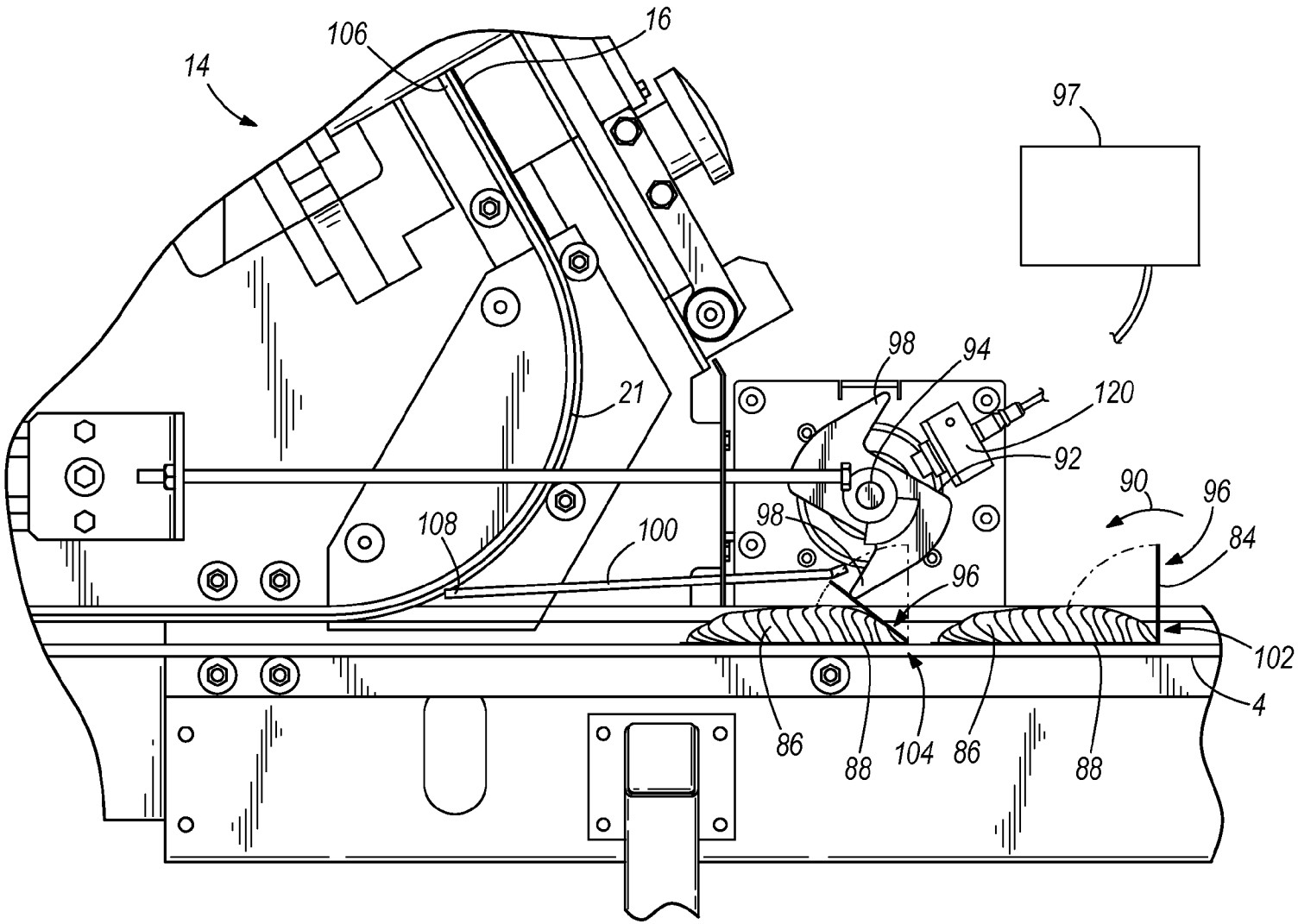
FIG. 6 is a side sectional view of the closing station of FIG. 5.

Now referring to FIGS. 5 and 6, the closing station 14 is located downstream of the loading station 12. The closing station 14 can be configured for closing the noted pocket P in the lower web 6 with the upper web 16. The particular example shown in the FIGURES is configured for use with a food product having an intermediate packaging material comprising a foldable flap 84 extending generally upwardly or outwardly with respect to the conveyor 4. This type of intermediate packaging is often utilized in packaging of food product, for example, sliced bacon 86 or other sliced and non-sliced products. The foldable flap 84 is part of a paper product material often referred to as a "J board" or an "L board" 88, which can be a folded sheet of cardboard or similar material. The bacon 86 and L board 88 are manually- or machine-loaded into a respective pocket P (FIG. 5) in the web 6 at the loading station 12 in an orientation wherein the foldable flap 84 of the L board 88 extends generally outwardly or vertically with respect to the conveyor 4 and is foldable down onto the bacon 86 as shown at arrow 90 in FIG. 6. The embodiment shown in the figures includes a web transport conveyor 4 carrying pair-wise arrangements of L boards 88 carrying bacon 86. At index of the conveyor 4, two pairs of L boards 88 are moved. This is only one example and the conveyor 4 can be configured to carry more or less packages per index length and width.

The closing station 14 includes an apparatus for folding the flap 84 of the L board 88 in the direction of arrow 90 such that the flap 84 overlaps the bacon 86 during the closing process. In the example shown, a plurality of movable dogs 92 rotates with a rotating shaft 94 located above and extending transversely relative to the conveyor 4. The shaft 94 can be driven into rotation by a motor 95, which can for example include a servo motor or other type of motor for operatively rotating the shaft 94. Dogs 92 includes at least one finger for engaging an upstream side 96 of the foldable flap 84. The particular configuration of the dog 92 can vary. In the example shown, dog 92 has a Z-shape in cross section and includes a pair of oppositely oriented engagement fingers 98. Rotation of the rotatable shaft 94 and the dogs 92 is properly timed with the indexing motion of the conveyor 4 such that the engagement fingers 98 engage with and force the upstream side 96 of the flap 84 to fold in the direction of arrow 90 at each 180-degree rotation of the dogs 92.

In one example, a programmable microprocessor or control circuit 97 is provided so that control of the positioning of the dogs 92 can be accomplished by an electronically created cam. In this example, the control circuit 97 is programmed to control the rotational orientation of the dogs 92 such that the dogs 92 are electronically linked to the horizontal position of chains on the conveyor 4 that advance the L board 88. This can be accomplished in such a manner that produces a precisely timed movement for index advancement of the L board 88 on the conveyor 4. This movement profile can be created by incrementally advancing the L board 88 on the conveyor 4 and then rotating the dogs 92 forwardly to a correct position in relation to the L board 88, sensing this position with a sensor, such as proximity sensor 120, and subsequently recording this position in a memory of the control circuit 97. By collecting these positions in the memory of the control circuit 97, the control circuit 97 can thereafter access the memory and control the servo motor 95 so as to accomplish a precise movement that is linked to the movement of the L boards 88 on the conveyor 4. This results in a non-linear rotational movement of the dogs 92, which is repeated when a linear index movement of the conveyor 4 occurs and that is adapted to changes in the speed of the index.

Figure 7:
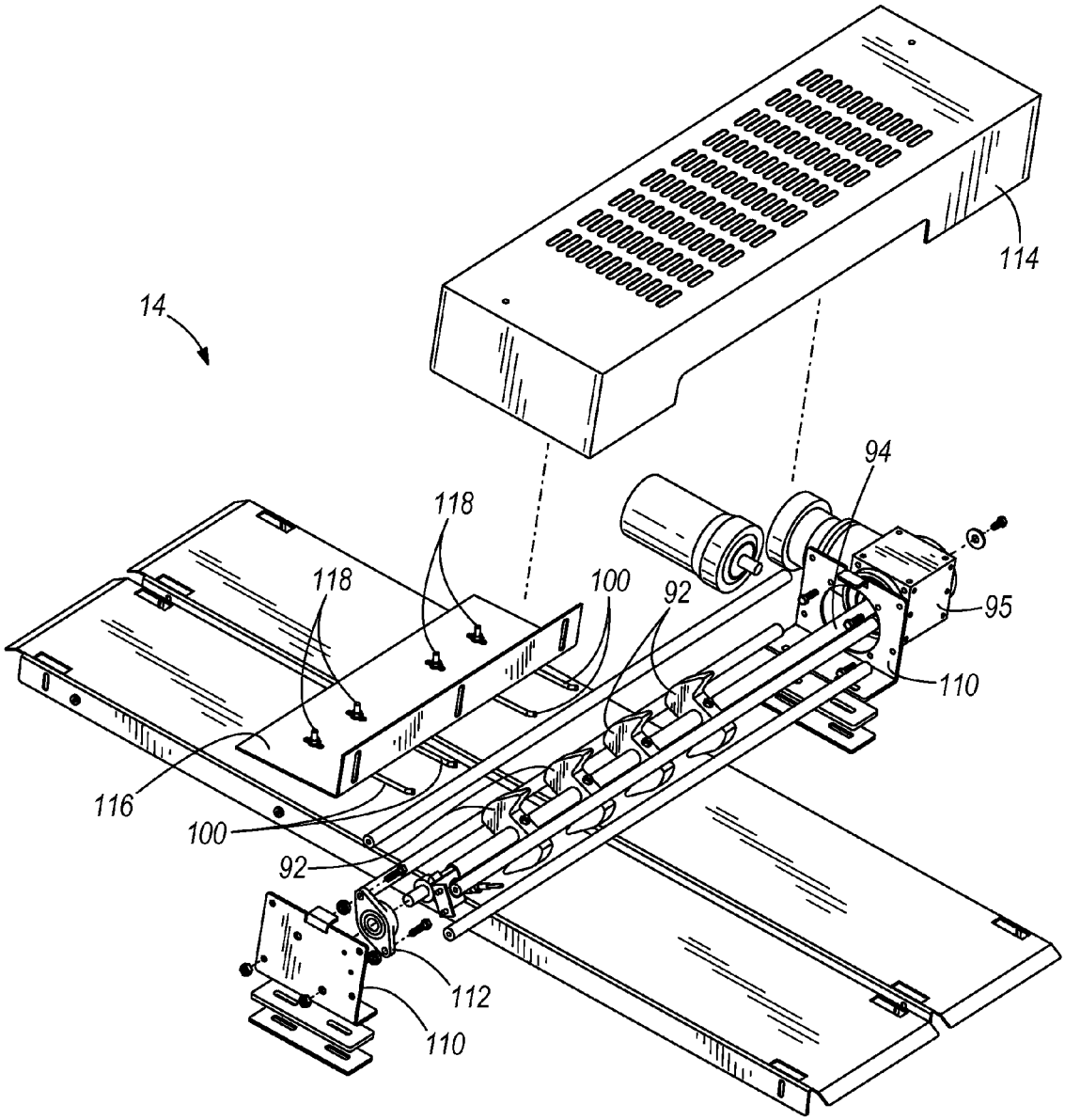
FIG. 7 is an exploded view of the closing station.

As shown in FIGS. 6 and 7, immediately downstream of the dogs 92 is a series of guide bars 100. As the conveyor indexes from upstream to downstream, and immediately after the dogs 92 fold the flap 84 from a first generally vertical orientation shown at 102 to a second generally angled (or folded) orientation shown at 104, the guide bars 100 engage with the upstream side 96 of the flap 84 and prevents the flap 84 from biasing back into the generally vertical orientation 102.

Conveyor 106 guides the web 16 to a location adjacent to the downstream end 108 of the guide bars 100. As the bacon 86 is indexed on the web 6 by the conveyor 4 past the downstream end 108 of the guide bars 100, the conveyor 106 causes the web 16, travelling along an arcuate path defined by conveyor 106, to engage the upstream side 96 of the foldable flap 84 and further fold the flap 84 onto the bacon 86. The web 16 is thus advantageously positioned by the conveyor 106 with respect to the guide bars 100 so that the flap 84 is maintained in a first folded position until the pocket is closed into a second folded position via engagement with the top web 16.

As the bacon 86 is indexed downstream, the closing station 14 further closes (e.g. seals) the package by mating the web 16 with the web 6 in a conventional manner. The flap 84 of the L board 88 is efficiently folded down onto the bacon 86 at the time of mating.

FIG. 7 depicts an exploded view of a portion of the closing station 14, showing the plurality of movable dogs 92 and the series of guide bars 100. The dogs 92 are supported for rotation along the rotating shaft 94, which is driven into rotation by the servo motor 95. As discussed above, the servo motor 95 is controlled by the control circuit 97. The rotating shaft 94 is supported for rotation by opposing brackets 110 and at one end by a bearing 112. A cover 114 can be provided on the assembly. The guide bars 100 are supported by a top plate 116 and can be adjusted with respect to the conveyor 4 by adjustment connections 118, which can be screws, for example.

Figure 8:
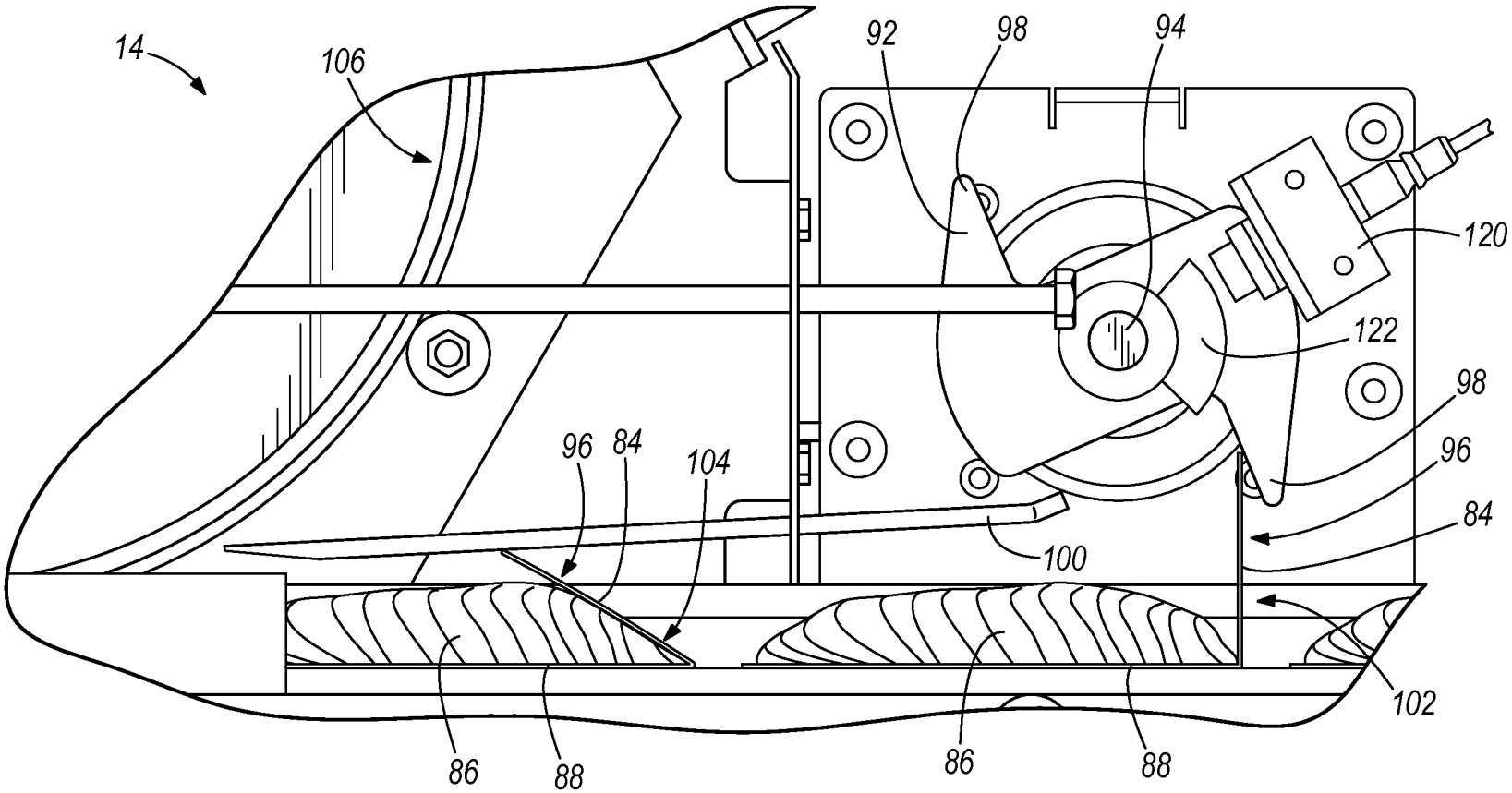
FIGS. 8-10 are like FIG. 6 and depict movement of food product and packaging through the closing station.
Figure 9:
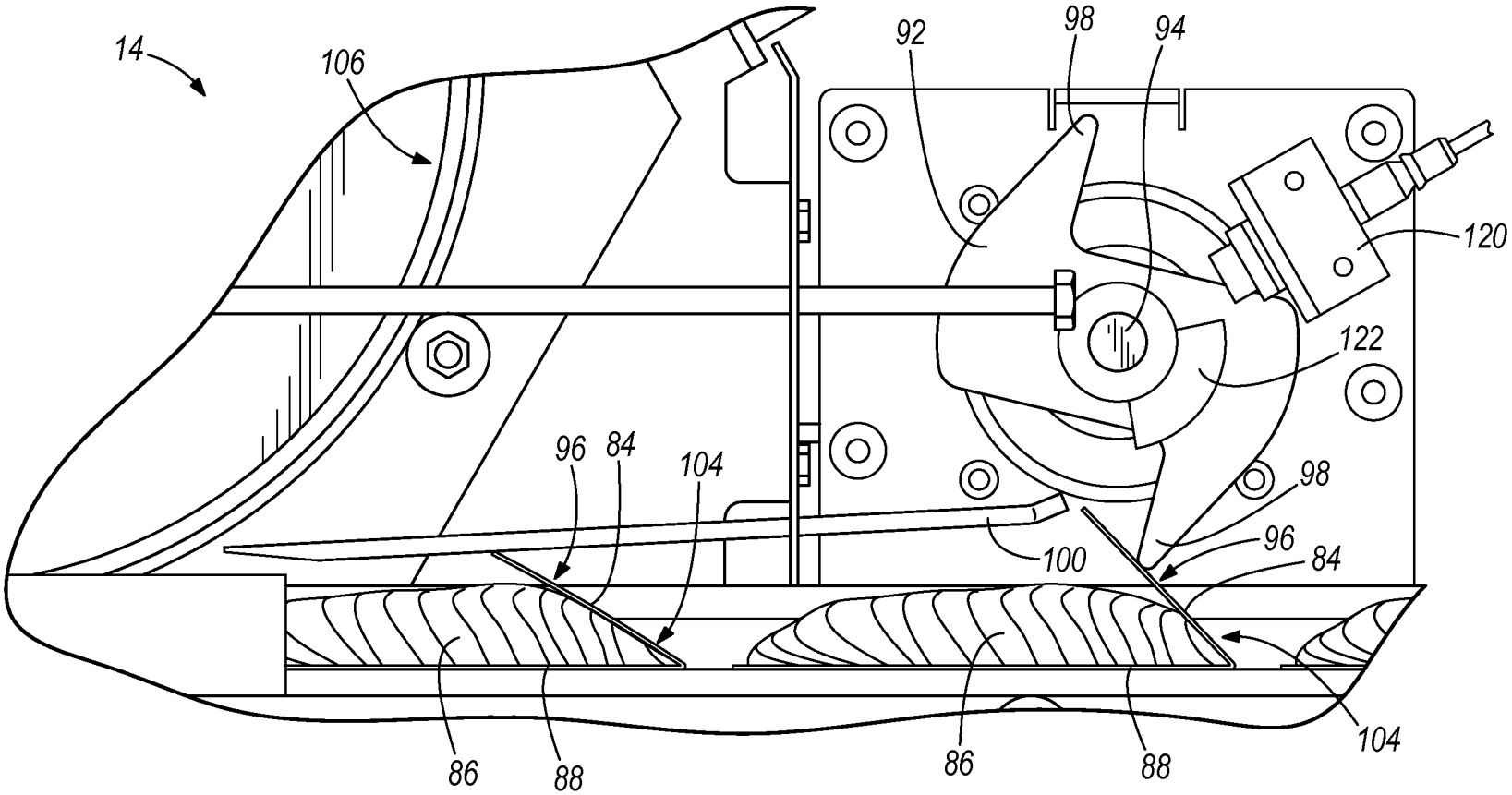
Figure 10:
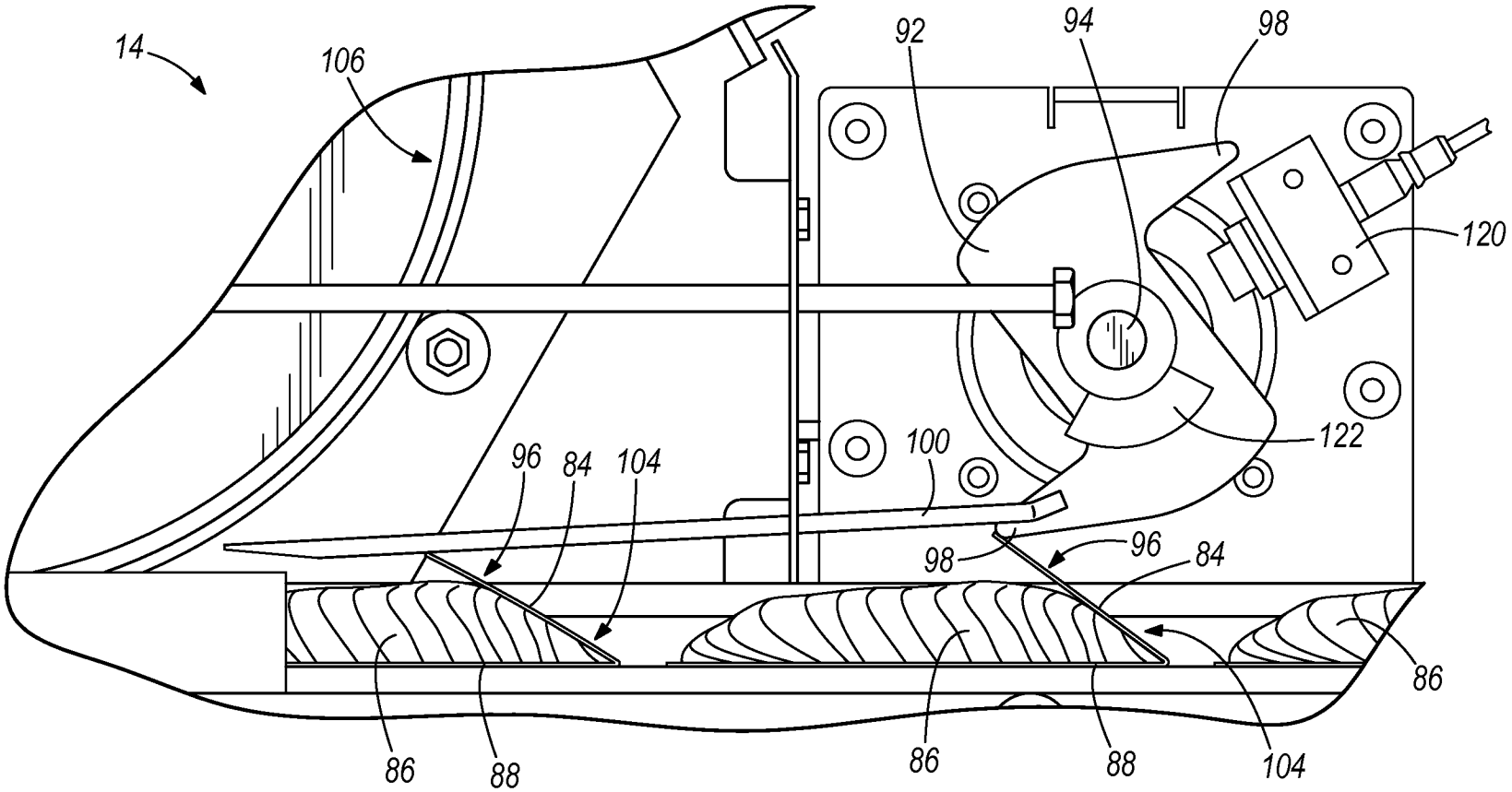

FIGS. 8-10 depict the dogs 92 during rotation to fold the foldable flap 84 down onto the bacon 86 through one index of the conveyor 4. As shown in FIG. 8, the first engagement finger 98 engages with the upstream side 96 of the L board 88. Referring to FIGS. 9 and 10, as the dog 92 rotates and the conveyor 4 indexes, the upstream side 96 of the L board 88 is positioned beneath the guide bar 100. This can be seen in series from FIGS. 8 through 10. During this movement, the proximity sensor 120 can sense position of the trigger 122 and communicate same to the control circuit 97 for saving in the memory, as described above.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means plus function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6, for any limitations of any of the claims herein, except for those in which the claim expressly uses the words "means for" together with an associated function.

What is claimed is:

1. A packaging apparatus for an indexing-motion packaging machine that has a web transport conveyor transporting a web of flexible packaging material from upstream to downstream locations, the packaging apparatus, comprising:

a series of stations including a forming station for forming at least one pocket in the web, a loading station for placing food product in the pocket, and a closing station for closing the pocket with another web of packaging material;

wherein the forming station comprises first and second forming die members, at least one of the first and second forming die members being movable between open and closed positions relative to the other of the first and second forming die members to form the pocket;

wherein the closing station comprises first and second closing die members, at least one of the first and second closing die members being movable between open and closed positions relative to the other of the first and second closing die members to close the pocket; and further comprising a lift that operatively couples at least three members of the first and second forming die members and first and second closing die members together such that operation of the lift counterbalances and moves the three members together between their respective open and closed positions;

wherein the forming station is located below the closing station.

2. An apparatus according to claim 1, wherein the first and second closing die members are both movable between open and closed positions to close the pocket and wherein the lift operatively couples the movable forming die member and the first and second closing die members together such that operation of the lift moves the movable forming die member, the first closing die member and the second closing die member.

3. An apparatus according to claim 1, comprising a servo motor operating the lift.

4. An apparatus according to claim 2, wherein the lift comprises at least one link member extending between the movable forming die member and at least one of the first and second closing die members.

5. An apparatus according to claim 4, wherein the link member comprises a first end that is pivotably coupled to the movable forming die member and a second end that is pivotably coupled to the at least one of the first and second closing die members.

6. An apparatus according to claim 2, wherein the lift rotates in a first direction to move the movable forming die member towards its closed position and the first and second closing die members towards their closed positions and wherein the lift rotates in a second, opposite direction to move the movable forming die member towards its open position and the first and second closing die members towards their open positions.

7. A packaging apparatus for a packaging machine that has a web transport conveyor transporting a web of flexible packaging material from upstream to downstream locations, the packaging apparatus comprising:

a series of stations including a forming station for forming at least one pocket in a first web of packaging material and a loading station for placing food product in the pocket, the food product having packaging material comprising a foldable flap extending generally outwardly away from the conveyor, and being folded from a first vertical orientation to a second angled orientation, wherein a closing station is located downstream of the loading station and is configured to close the pocket with a second web of packaging material;

wherein the second web of packaging material is oriented in the closing station so as to engage with the first web of packaging material and also fold the foldable flap downwardly with respect to the conveyor as the conveyor moves from upstream to downstream;

wherein the second web of packaging material follows an arcuate path toward the conveyor so as to engage an upstream side of the foldable flap and fold the foldable flap downwardly with respect to the conveyor; and at least one movable dog located upstream of the engagement between the first and second webs of packaging material, the movable dog folding the foldable flap downwardly with respect to the conveyor towards the food product.

8. A packaging apparatus according to claim 7, wherein the at least one movable dog rotates to engage with the foldable flap as the conveyor carries the food product past the at least one movable dog.

9. A packaging apparatus according to claim 8, comprising a servo motor rotating the at least one movable dog.

10. A packaging apparatus according to claim 8, wherein the at least one movable dog comprises at least one finger for engaging an upstream side of the foldable flap.

11. A packaging apparatus according to claim 8, wherein the at least one movable dog comprises opposing fingers for engaging with an upstream side of the foldable flap during 180 degree rotation of the at least one movable dog.

12. A packaging apparatus according to claim 7, comprising at least one guide bar located downstream of the at least one movable dog, the guide bar guiding the foldable flap in a first folded position towards the engagement between the first and second webs of packaging material.

13. A packaging apparatus according to claim 12, wherein the engagement between the first and second webs of packaging material folds the foldable flap into a second folded position.

14. A packaging apparatus according to claim 7, comprising a control circuit programmed to control the relative speeds of the web transport conveyor and the at least one movable dog.

15. A packaging apparatus according to claim 14, wherein the control circuit controls the speed of the web transport conveyor in a linear indexing motion and wherein the control circuit controls the at least one movable dog in a non-linear movement.

16. A packaging apparatus according to claim 14, comprising a position sensor sensing position of the at least one movable dog and communicating the sensed position to the control circuit.

17. A packaging apparatus according to claim 14, comprising a first servo motor moving the web transport conveyor and a second servo motor moving the at least one movable dog.

18. A packaging apparatus according to claim 7, comprising a plurality of movable dogs folding the foldable flap downwardly with respect to the conveyor.

19. A packaging apparatus according to claim 7, wherein the second web of packaging material is fed from another conveyor located between the loading station and the forming station for forming the at least one pocket in the first web of packaging material.

* * * * *